United States Patent [19]

Centafanti

[11] Patent Number: 4,496,156

[45] Date of Patent: Jan. 29, 1985

[54] GOLF PRACTICE DEVICE

[76] Inventor: Rocco Centafanti, 27 India St., Portland, Me. 04101

[21] Appl. No.: 469,229

[22] Filed: Feb. 24, 1983

[51] Int. Cl.[3] ..... A63B 69/36

[52] U.S. Cl. ..... 273/184 B

[58] Field of Search ..... 273/200 B, 184 B, 185 C, 273/197 R, 197 A

[56] References Cited

U.S. PATENT DOCUMENTS

| | | | |
|---|---|---|---|
| 1,509,825 | 9/1924 | Caton | 273/184 B |
| 1,722,848 | 7/1929 | Kappeler | 273/197 A |
| 1,732,971 | 10/1929 | Kappeler | 273/197 R |
| 1,889,332 | 11/1932 | Jones et al. | 273/184 B |
| 1,940,033 | 12/1933 | Von Schlegell | 273/185 C |
| 3,591,185 | 7/1971 | Murat | 273/197 A X |
| 3,837,654 | 9/1974 | Hall | 273/200 B X |

FOREIGN PATENT DOCUMENTS

| | | | |
|---|---|---|---|
| 341178 | 1/1931 | United Kingdom | 273/200 R |
| 687402 | 2/1953 | United Kingdom | 273/185 C |

*Primary Examiner*—George J. Marlo

[57] ABSTRACT

Apparatus for use in practicing the driving of golf balls has a stand provided with a laterally disposed arm provided with a rotor to which a golf ball is held captive by means of a depending arm connected to the ball by a cord. A meter records the number of revolutions of the rotor each time the tethered ball is driven enabling the relative distance the ball would have been driven, if free, to be evaluated. This result is attained by utilizing a meter having a push type actuator and by providing the depending arm with a horizontally supported member disposed towards the stand and having a path inclusive of the actuator which is thereby engaged by the member each time a struck ball orbits.

1 Claim, 4 Drawing Figures

14
22
24
23
11
21
22
14
16
9
5
15
17
18
6

24
23
11
7
22
14
8
16
20
15
5
9
18
17
19
19A
6

14
22
24
23
11
13
12
12
10
7
14
21
22

GOLF PRACTICE DEVICE

BACKGROUND REFERENCES

U.S. Pat. No. 1,609,725
U.S. Pat. No. 1,804,040
U.S. Pat. No. 2,338,697
U.S. Pat. No. 2,470,807
U.S. Pat. No. 3,837,654

BACKGROUND OF THE INVENTION

The need for practice by golf players has long been recognized as not being satisfied simply by practice swings. As a consequence, there are driving ranges in many localities where sufficient land is available for the long distance properly driven balls travel.

The need has also been recognized in the several above referred-to United States patents, for apparatus enabling golf swings, particularly driving swings to be practiced indoors with a captive ball. Each such apparatus contemplated the approximation of the distance the struck ball would have travelled if free.

Such apparatus are of two types of which one provided for the attachment of a ball to one end of a rigid member which was rotatably supported with its axis horizontal thereby permitting the struck ball to have an orbital path. The use of such a rigid member has the disadvantage that the force with which a ball is hit is directly transmitted thereto destroying the free flight effect.

In the other type of apparatus, a cord or cable was tethered by a cord wound on a drum positioned laterally of the tee site with the drum provided with means resiliently limiting the distance a struck ball would travel. This arrangement had the disadvantage that the ball could not have an orbital path.

THE PRESENT INVENTION

The general objective of the present invention is to provide apparatus for use in practicing the swinging of golf clubs, particularly drivers, with a tethered ball that may orbit and still have a free flight effect.

In accordance with the invention, that objective is attained with apparatus having a horizontal arm disposed towards the station for the person using the apparatus and in a position such as to be within the path of that person's hands when making a full swing as in driving. A ball is supported by that arm by means of a length of cord or cable having one end anchored to the ball and the other end connected to the arm of a rotor carried by the horizontal arm in a manner enabling the tethered ball to orbit with a substantial degree of free flight effect since the plane of orbit relative to the rotor axis varies from normal somewhat if the ball is not properly hit.

Another objective of the invention is to provide apparatus of the above type having means enabling the distance the tethered ball would have been driven if free to be evaluated. This objective is attained by means of a counter actuated by means carried by the orbiting arm which, with the known orbit of the tethered ball, provides information both as to force applied to the ball and whether or not it was properly hit as the departure of the plane of orbit from a normal plane is noticeable and has some adverse effect on the turning of the rotor.

PRIOR ART STATEMENT

The above referred-to patents are the only prior art known to me that are of interest in connection with the present invention as each discloses apparatus for use in practicing the swinging of golf clubs with a captive golf ball.

With the exception of U.S. Pat. Nos. 1,609,725 and 2,338,697 in which golf balls are tethered, the balls were held at one end of a rigid rotatably supported arm.

In U.S. Pat. No. 1,804,040 the rigid arm was horizontal and connected to a vertical shaft, the turning of which was used to actuate dials indicative of yardage.

In U.S. Pat. No. 2,470,807 the rigid arm was attached to a horizontal shaft by which a pointer was turned relative to a dial to indicate yardage a ball was driven.

U.S. Pat. No. 3,837,654 provided a construction in which means were employed to indicate whether a driven ball, held captive by rigid means, would have been "hooked" or "sliced".

In U.S. Pat. No. 1,609,725, the cable by which a golf ball was tethered was wound about a drum having a vertical axis of rotation with rotation resiliently opposed and employed to swing a pointer about a yardage scale and U.S. Pat. No. 2,338,697 disclosed a somewhat similar construction but with the drum axis horizontal and the yardage scale operated by a rack and pinion with the rack actuated by axial movement of the drum.

BRIEF DESCRIPTION OF THE DRAWINGS

The accompanying drawings illustrate a preferred embodiment of the invention of which

THE PREFERRED EMBODIMENT OF THE INVENTION

Figure 2:
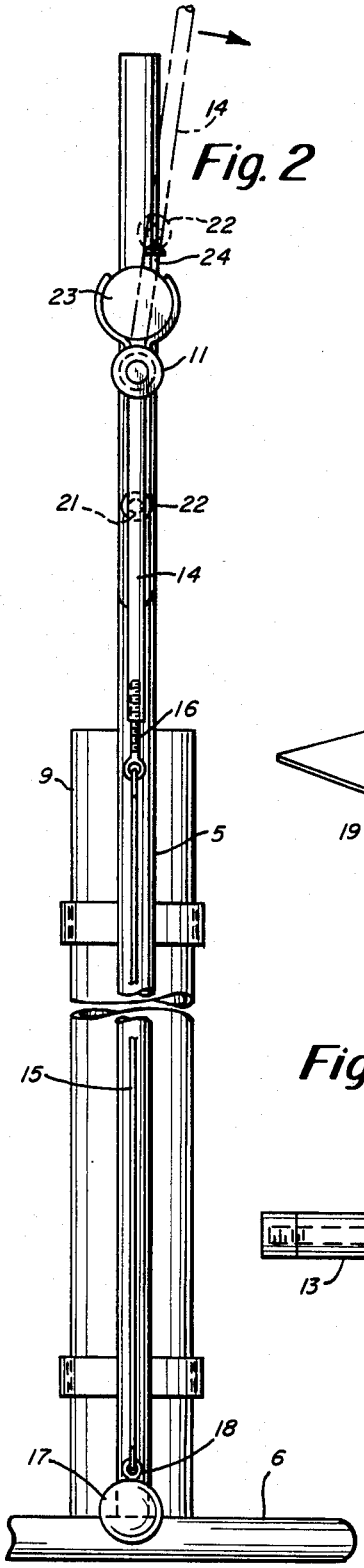
FIG. 2 is a front view of the apparatus on a substantial increase in scale.
Figure 1:
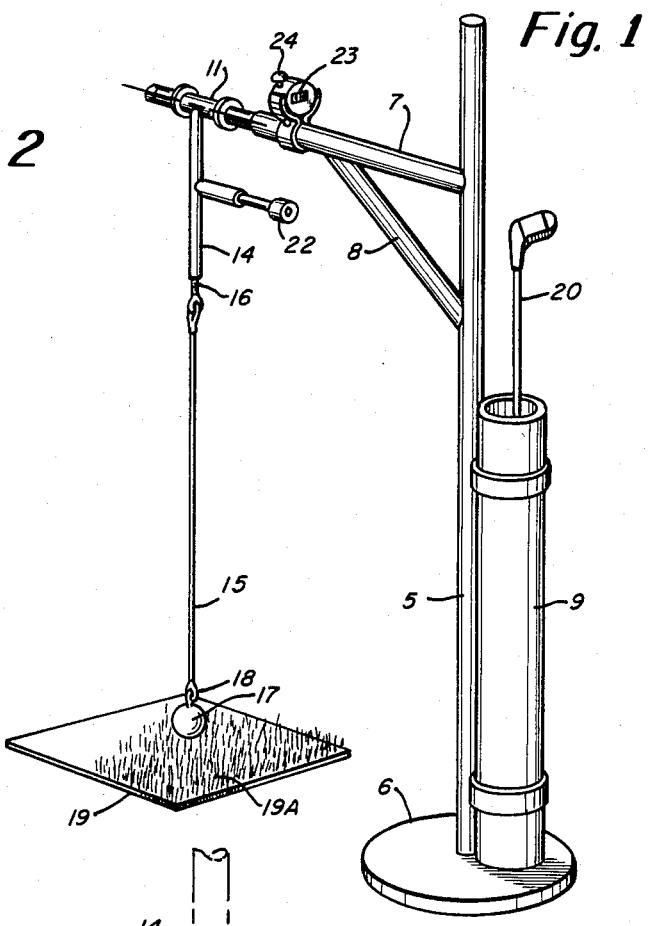
FIG. 1 is a perspective view of the apparatus.
Figure 3:
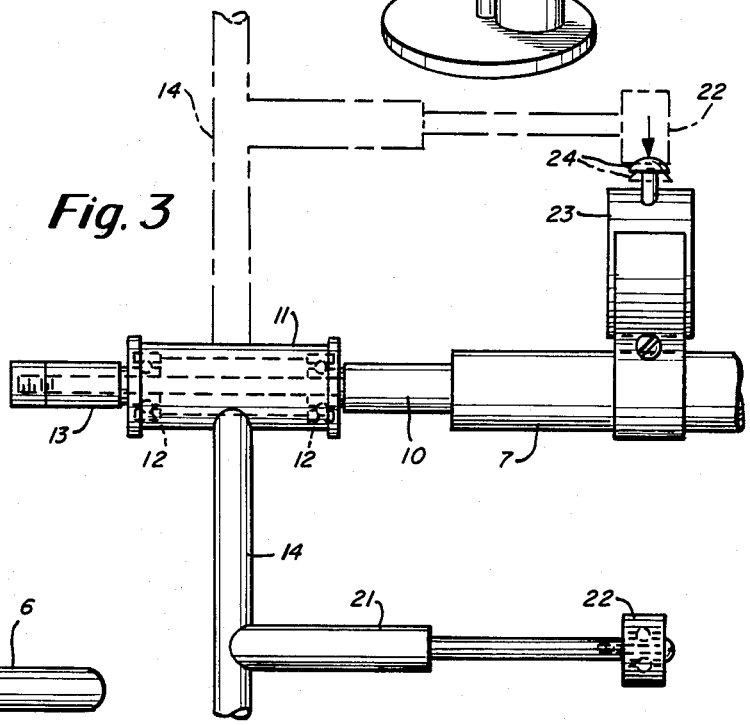
FIG. 3 is a fragmentary view, on a further increase in scale, of the horizontal arm, the counter, the hub, its radial arm and the counter actuator carried by the radial arm.
Figure 4:
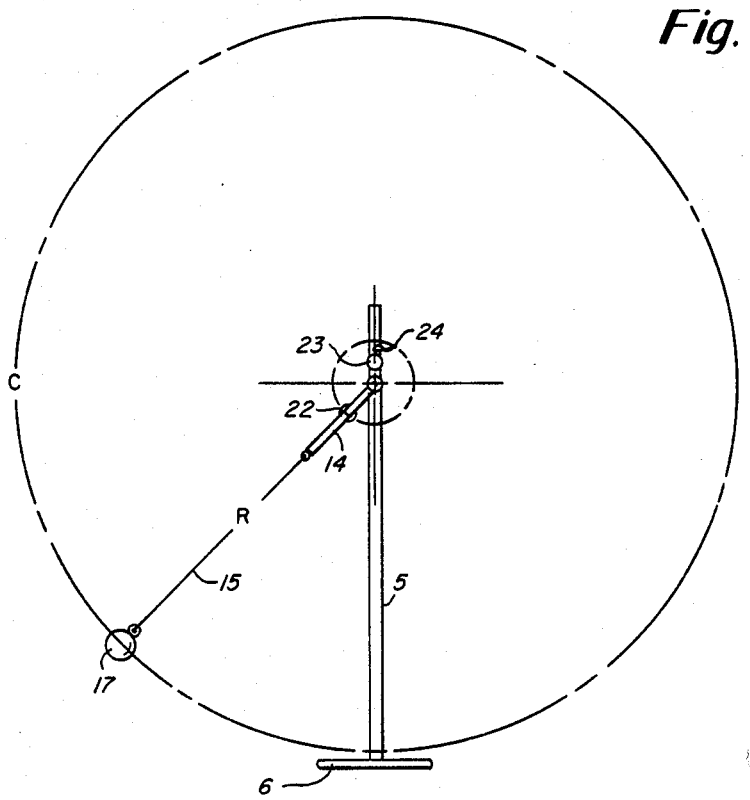
FIG. 4 is a schematic front view of the apparatus illustrating the orbit of a ball.

The apparatus illustrated by the drawings has an upright post 5 supported by a base 6 and provided with a horizontal arm 7 connected to the post 5 by a brace 8. A golf club holder 9 supported by the base 6 is clamped to the post 5. In practice, the post 5, the brace 8 and the arm 7 are of tubular stock, one inch chrome plated pipe stock by way of preference. The arm 7 extends towards the station where a person stands when using the apparatus.

The free end of the arm 7 serves as a socket for an insert 10 having an outer end of reduced diameter which serves as an axle on which a rotor or hub 11 is rotatably supported by bearing units 12 and held captive by a retainer 13 threaded on the outer end of the axle.

The rotor 11 has a radial arm 14 to which a cord 15, preferably nylon, is attached by means of an adjustable connection 16 with the cord 15 connected to a ball 17 by a screw eye 18 threaded into the ball 17 and preferably of a length such that it extends diametrically deep into the ball. The arm 7 is supported at a height such that the rotor axis is within the path of the hands of the person making a full swing with a golf club. The length of the cord 15 and the radial arm 14 is usually such as to support the ball 17 a distance above the mat 19 so as to represent a teed ball with the adjustable connection 16 enabling any stretching of the cord to be offset or to enable the ball 17 to rest on the mat 19 if a golf club other than the driver 20 is to be used. It is preferred that the mat 19 have a surface 19A representative of grass which the tethered ball may engage if any such other club is used.

In use, the tethered ball 17 is driven in a conventional manner and because of the cord 15, the effect of a free driven ball is attained and, whether or not the ball is properly struck, it has an orbit about the axis of the hub rotor 11. Such an orbit, in the case of a properly struck ball, is in a plane normal to that axis while if improperly hit, the orbit due to the length of the cord 15 is noticeably different. It is preferred that the length of the cord is greater than that of the radial arm 14. A cord length twice that of the arm 14 has proved satisfactory.

In order that the distance a driven ball would have travelled, if free, may be approximated or evaluated, the radial arm 14 has a laterally disposed arm 21 extending towards the post 5 and provided with a striker in the form of a roller 22 so positioned that in its path, as a ball orbits, it will engage and operate the actuator 24 of a counter 23. In practice, the distance between the ball and the hub axis is established so that a driven ball will have an orbit of twenty feet so that a count of say fifteen orbits would represent a distance of three hundred feet as an evaluation of the effect of a driven ball, properly hit with maximum force. With the orbit of a struck ball of twenty feet, the combined length of the arm 14 and the cord 15 ids approximately three feet. It is recognized that inertia of the moving parts to which the ball is connected affects the count to some extent and it should be noted that the orbit of a ball in a non-normal plane also affects the number of orbits which is an important feature of the invention. Special counters can be used to more nearly approximate the distance the ball would have been driven if free.

I claim:

1. Apparatus for use in practicing golf ball driving with a golf ball, said apparatus including a vertical support provided with a laterally disposed arm, a counter mounted on said arm and having an actuator operated by a downward push, a rotor, means connecting said rotor to said support with the rotor axis horizontal and the rotor offset relative to the support to overlie a theoretical tee site, said rotor including a rigid member disposed normal to the axis thereof and provided with a horizontal arm disposed towards the vertical support and including a member positioned to have a path inclusive of the actuator as the rotor turns, the counter so positioned that the actuator is engaged immediately after the ball passes through the zenith of its orbit, a golf ball, a flexible tether connecting said ball to the free end of the rigid member, said rotor axis spaced from the tee site a distance such that a ball struck with driving force will have an orbital path greater than the height of the person using the apparatus, and the length of said rigid member such as both to initiate the turning of said rotor and to limit the extent to which the path of a struck ball can depart from the normal plane established by the rigid member.

* * * * *